United States Patent [19]

Petterson et al.

[11] Patent Number: 5,076,466

[45] Date of Patent: Dec. 31, 1991

[54] FOLDED SHEET PRODUCT DISPENSER WITH ANTI-OVERFILL MECHANISM

[75] Inventors: Tor Petterson, Rancho Palos Verdes; Jean T. McGregor, Brightview, both of Calif.

[73] Assignee: James River II, Inc., Oakland, Calif.

[21] Appl. No.: 667,862

[22] Filed: Mar. 12, 1991

[51] Int. Cl.[5] ..... B65H 1/00

[52] U.S. Cl. ..... 221/46; 221/52; 221/57; 221/59; 312/61

[58] Field of Search ..... 221/45, 41, 52, 56, 221/57, 58, 59, 151, 152, 227, 279; 312/61, 71

[56] References Cited

U.S. PATENT DOCUMENTS

| | | | |
|---|---|---|---|
| 1,682,580 | 8/1928 | Pratt . | |
| 1,993,885 | 3/1935 | Horwitt . | |
| 2,080,691 | 5/1937 | Broeren . | |
| 3,095,996 | 7/1963 | Babin . | |
| 3,208,636 | 9/1965 | Filipowicz | 221/57 |
| 3,214,227 | 10/1965 | Filipowicz . | |
| 3,370,748 | 2/1968 | Koerper et al. . | |
| 4,329,001 | 5/1982 | Filipowicz et al. . | |
| 4,679,703 | 7/1987 | De Luca . | |
| 4,838,454 | 6/1989 | Salzmann et al. . | |

*Primary Examiner*—H. Grant Skaggs
*Attorney, Agent, or Firm*—Thomas R. Lampe

[57] ABSTRACT

A dispenser for serially dispensing folded sheet products from a stack of folded sheet products, includes a housing, a support member movable mounted within the housing, and a follower for urging the stack in the direction of a dispenser element included in the support member. The apparatus includes mechanism for engaging the follower and retaining it at a predetermined location relative to the support member when the support member is in open condition and which is disengaged from the follower when the support member moves to its closed position to compensate for any overfilling of the dispenser.

10 Claims, 6 Drawing Sheets

FOLDED SHEET PRODUCT DISPENSER WITH ANTI-OVERFILL MECHANISM

TECHNICAL FIELD

This invention relates to apparatus for serially dispensing folded sheet products, such as paper napkins, from a stack of such products. More particularly, the apparatus incorporates a mechanism which automatically relieves pressure exerted at the dispensing end of the apparatus as a result of overfilling the apparatus with an excessive number of folded sheet products.

BACKGROUND ART

Many dispensers are known in the prior art for serially dispensing folded sheet products such as paper napkins from a stack. Such dispenser apparatus range from the highly complex, incorporating relatively complicated and intricate mechanisms to effect dispensing, to the very simple, which may be little more than a box with a hole to permit manual access to the folded sheet product and removal thereof.

Many dispensers have been specifically designed for use in institutional environments. For example, fast-food restaurants make widespread use of paper napkin dispensers which characteristically include a housing for storing a stack of napkins and a nose piece or outlet element defining an opening through which the napkins are individually retrieved by a customer. Not uncommonly, great volumes of paper napkins are dispensed by such apparatus and they must be refilled relatively frequently by the restaurant staff.

Over-stuffing of the dispenser often occurs during the refilling operation. That is, persons replenishing the supply of paper napkins in the dispenser often refill it with more napkins than it is designed to accommodate.

Over-stuffing of a paper napkin dispenser can cause significant problems. Obviously, an over-filled dispenser will result in increased frictional forces not only between the napkins in the stack but between the end-most napkin and the end piece or dispensing element defining the opening through which the napkins are removed. It is occasionally virtually impossible to remove the end-most napkin without ripping or tearing it. The frustrated customer then, more often than not, resorts to manually extracting not just a single napkin but a whole pad consisting of several napkins. Even if such were not the case, significant waste of paper napkins occurs simply due to the ripping and tearing which occurs until enough paper napkins have been removed to sufficiently relieve stack pressure at the outlet.

A number of approaches have been devised to solve the over-fill problem. For example, it is known to provide a dispenser cabinet or housing with a refill opening which extends only part way along the housing, the idea being to allow some extra housing capacity. This approach, however, is not always successful because the person filling the cabinet or housing still may easily stuff more napkins into the housing than its capacity dictates. In other words, there is no positive means for preventing over-stuffing in such arrangements.

While mechanisms do exist which in effect expand the capacity of the housing after it has been filled to relieve stack pressure, such arrangements are characterized by their relative complexity and high cost. Furthermore, the reliability of some of these prior art systems is questionable.

DISCLOSURE OF INVENTION

The present invention relates to a dispenser apparatus for serially dispensing folded sheet products from a stack of such products. The particular embodiment illustrated is for use in serially dispensing paper napkins. The apparatus incorporates structural components which cooperate in a unique manner to prevent overfilling thereof. Such structure is characterized by its simplicity, relative low cost, and reliability. Furthermore, the dispenser apparatus is highly compact, making efficient use of space.

The dispenser apparatus includes a housing defining an interior and having an open end. A support member is selectively movably mounted relative to the housing between a first position and a second position and includes a support wall for supporting a stack of folded sheet products. A dispenser element or nose piece defining a dispensing opening is connected to the support wall. The support wall is disposed within the housing when the support member is in its first position.

Follower means is provided and the follower means is mounted for slidable movement along a predetermined path of movement relative to the support member. Biasing means biases the follower means in the direction of the dispenser element.

Retention means is incorporated in the dispenser apparatus for engaging the follower means and for retaining the follower means at a predetermined location relative to the support member when the support member is in the second position. The retention means is disengaged from the follower means when the support member moves from the second position to the first position.

The retention means includes a retention member positioned in the path of movement of the follower means when the support member is in the second position. The apparatus additionally comprises engagement means engageable with the retention means when the support member moves from the second position to the first position to withdraw the retention member from the path of movement of the follower means.

Other features, advantages, and objects of the present invention will become apparent with reference to the following description and accompanying drawings.

BEST MODE FOR CARRYING OUT THE INVENTION

Figure 1:
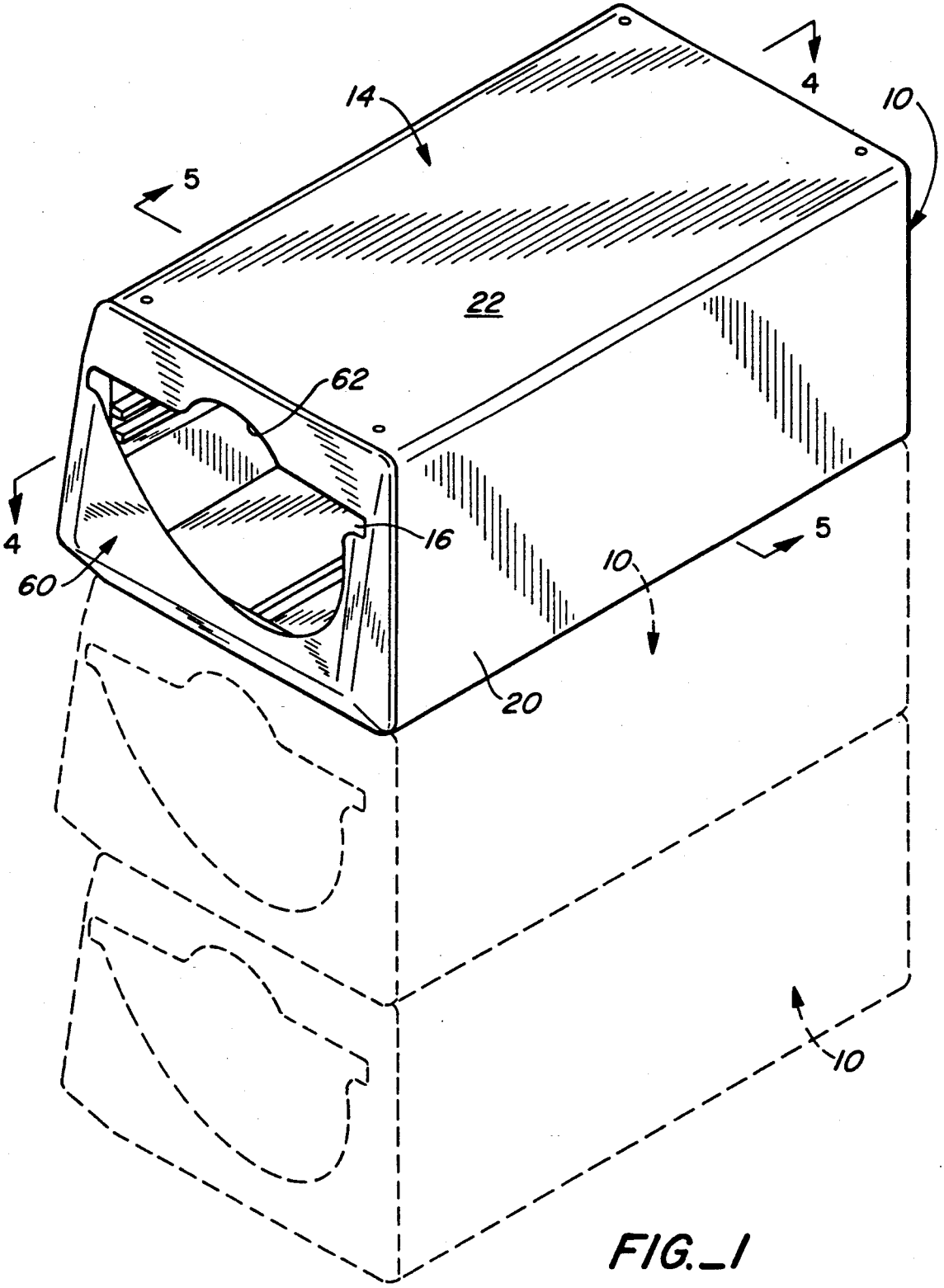
FIG. 1 is a perspective view of dispenser apparatus constructed in accordance with the present invention, the figure also illustrating how the apparatus may be stacked.

Referring now to the drawings, dispenser apparatus constructed in accordance with the teachings of the present invention is generally designated by reference numeral 10. The apparatus is for the purpose of serially dispensing folded sheet products from a stack of the folded sheet products. In the embodiment illustrated, such products are paper napkins 12.

Apparatus 10 includes a housing 14. The housing defines an interior 16 and an open end 18.

The housing, in the form disclosed, includes an extruded plastic housing member 20 having a top wall 22 and side walls 24, 26. A plurality of projections in the form of opposed elongated elements 30, 32, 34, and 36 project inwardly from the side walls and extend the length of the side walls.

Housing 14 also includes a second housing member 40 having a bottom wall 42 and a back wall 44. A top panel 46 extends partially over the bottom wall and under top wall 22. The first and second housing members 20, 40 are secured together by any desired expedient, such as mechanical fasteners, to provide an integral housing unit. It will be appreciated that the second housing member imparts strength and rigidity to the first housing member 20.

A drawer-like support member 50 is slidably disposed relative to housing 14. The support member includes a bottom or support wall 52 and side walls 54, 56. Side walls 54, 56 are flared outwardly at the upper ends thereof to engage side walls 24, 26, respectively. The support wall 52 extends beyond the side walls 54, 56 to form flanges 58. Flanges 58 are disposed between elongated elements 34, 36 while the outwardly flared distal ends of side walls 54, 56 are disposed immediately below elongated element 32 to stabilize and guide the support member 50 when it is moved relative to the housing 14.

Support member 50 also includes a dispenser element or nose piece 60 defining a dispensing opening 62 through which the end-most paper napkin 12 in the stack disposed in the housing interior can be manually accessed and retrieved. Dispenser element 60 is affixed in any suitable fashion to support wall 52 and side walls 54, 56.

The central portion 72 of the support wall 52 cooperates along with flanges 58 and their operative relationship with elongated elements 36 to maintain most of the support wall 52 out of engagement with bottom wall 42 of the second housing member 40 and form a space therebetween.

A follower 66 is mounted for slidable movement within support member 50 along a path of movement extending from the front end 18 of the housing to the back wall 54. The follower includes follower plate 68 and side walls 69.

Biasing means is employed to bias the follower in the direction of dispenser element or nose piece 60. More particularly, the biasing means includes two helical coil springs 76, 78 secured at the ends thereof to housing top wall 22. Springs of this nature are known in the art, one suitable example being Negator springs made available by Ametek, Sellersville, Penna. Such springs are advantageous insofar as the present arrangement is concerned because they exert a generally uniform biasing pressure regardless of the degree to which they are wound.

At the ends of the springs positioned within the spring coils, the springs form tabs 81 which are disposed in notches 83 of a shaft 85. Shaft 85 is located within indents 87 formed in the side walls 69 of the follower. The springs bias the shaft against the follower side walls and the follower is biased toward the nose piece 60. Disks 89 projecting from the shaft assist in maintaining proper positioning between the follower, the shaft, and the springs.

Figure 2:
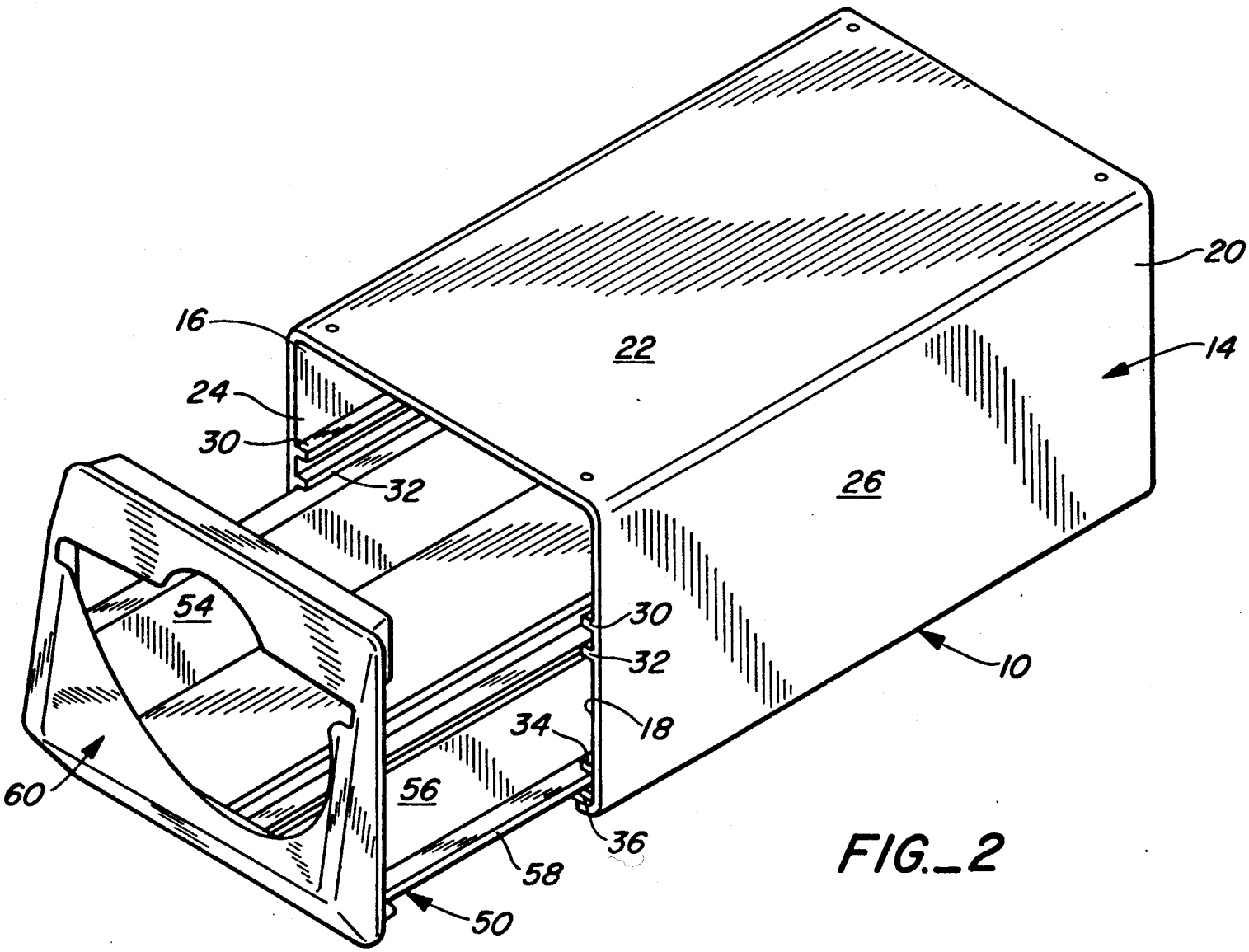
FIG. 2 is a perspective view of the apparatus illustrating the support member thereof extending from the apparatus housing.

Retention means is provided for engaging the follower plate and for retaining the follower plate at a predetermined location relative to the support member 50 when the support member has been moved from its normally closed position, hereinafter the first position, to a second position wherein the support member extends outwardly from the open end of the housing. FIG. 2 shows the support member 50 extending part way out of the housing.

The support member 50 is adapted to be manually moved between the first and second positions. The second position, of course, allows the apparatus to be readily replenished with paper napkins. When the support member 50 is in its second (extended) position the person filling the dispenser apparatus pushes follower plate 66 away from dispenser element 60 so that the stack of napkins may be positioned in front of the follower plate.

The present apparatus includes retention means for engaging the follower plate and for retaining the follower plate at a predetermined location relative to the support member when the support member is in its second position, the retention means being disengaged from the follower means when the support member moves from the second position to the first position. The retention means includes a retention member 80 defining a notch 82.

The retention member is selectively movable through an opening 84 formed in support wall 52 at a predetermined location with respect thereto. Such location is spaced a preselected distance from the inner terminal end of the support member. The retention member is connected to the bottom of support wall 52 by a leaf spring 86 which continually urges the retention member 80 upwardly through the opening 84 as shown in FIG. 6.

Figure 6:
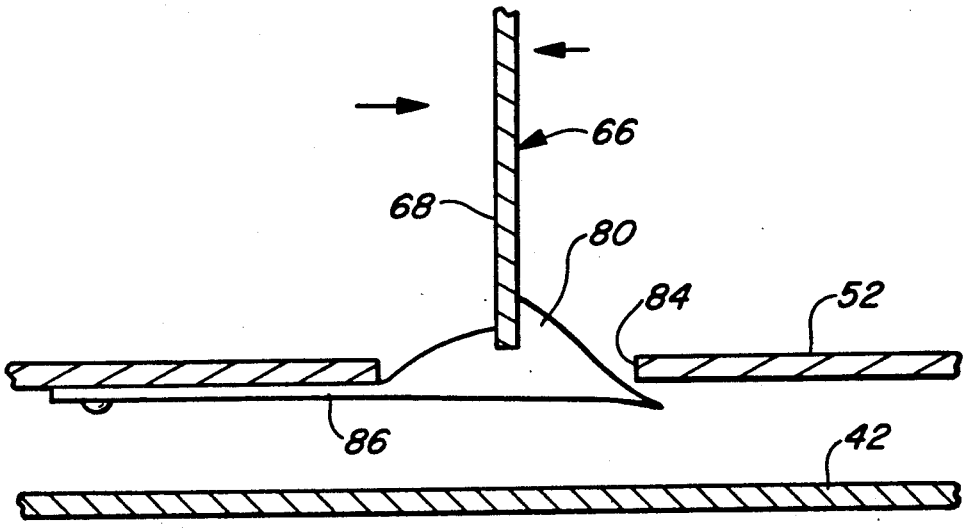
FIGS. 6 and 6A are enlarged, cross-sectional, detail views of selected structural components of the present invention illustrating the relative positions assumed thereby during two different stages of the operation of the apparatus, as taken along line 6—6 of FIG. 3.

When the retention member 80 projects upwardly through the opening 84 as shown in FIG. 6, the follower plate 66 is captured by the notch 82 and locked against either forward or rearward movement when the person filling the dispenser apparatus pushes the follower plate to the groove location. The person may now use both hands to fill the apparatus.

Figure 6A:
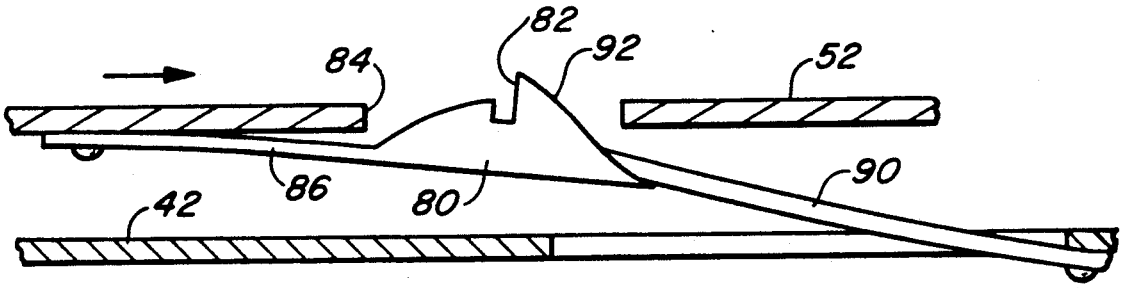

After the apparatus has been filled, the operator closes the dispenser apparatus by pushing the support member to its first or closed position. As this occurs, the retention member 80 engages engagement means in the form of an inclined plate 90 which is affixed to bottom wall 42 and projects upwardly therefrom as shown in FIG. 6A. The distal end of inclined plate 90 forms a cam surface which cooperates with the cammed rear surface 92 of retention member 80. FIG. 6A illustrates relative positions assumed by the retention member 80 and the inclined plate 90 just after initial engagement is had therebetween. It will be appreciated that further movement of support wall 52 and the retention member 80 to the right as shown by the arrow in FIG. 6A will completely drop the upper end of the retention member 80 below opening 84, thus disengaging the follower plate 66 from notch 82.

If the apparatus has been over-stuffed during refilling thereof to a sufficient degree so that the pressure of the napkin stack exerted against the left side of follower plate 66 is greater than the pressure exerted upon the right or rear side thereof by the springs 76, 78, the follower plate will move to the right until an equilibrium is reached. Of course, if the pressure of the stack is less than the force exerted by the springs, the plate will move to the left, exerting greater pressure against the stack. Thus, the present arrangement operates to automatically relieve the pressure of the stack only when necessary.

Figure 3:
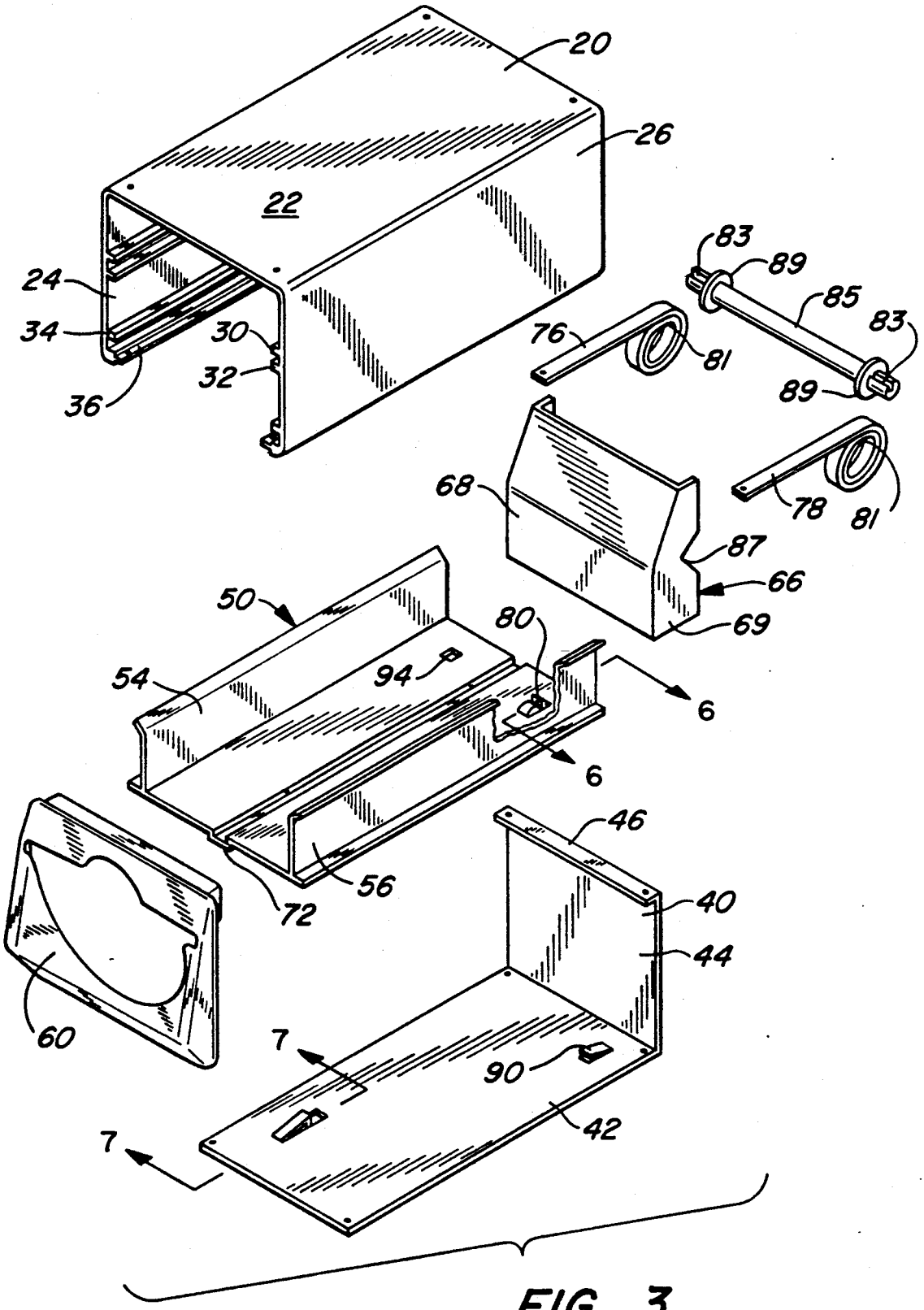
FIG. 3 is an exploded, perspective view illustrating the principal components of the apparatus.
Figure 4:
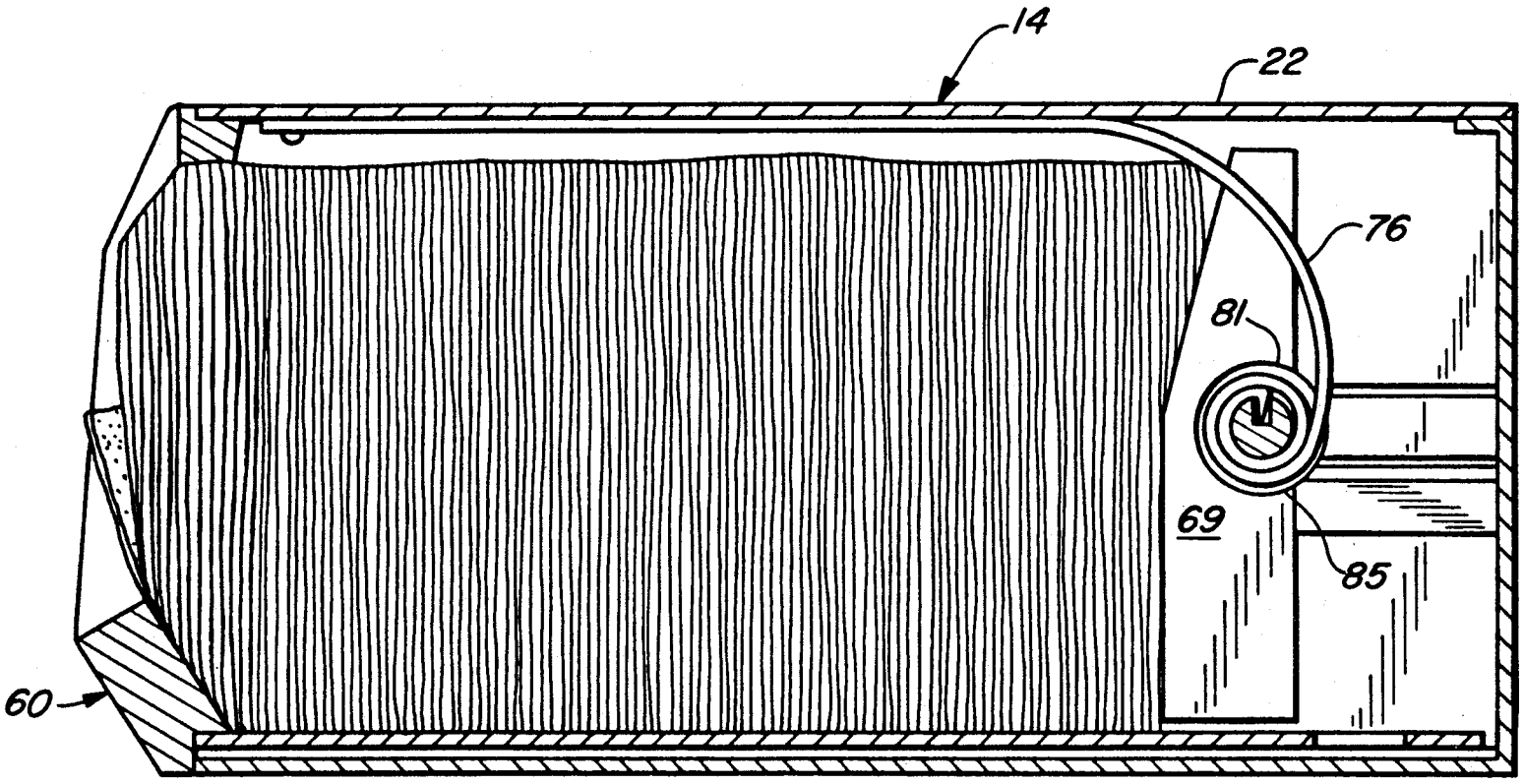
FIG. 4 is a cross-sectional view taken along the line 4—4 in FIG. 1.
Figure 5:
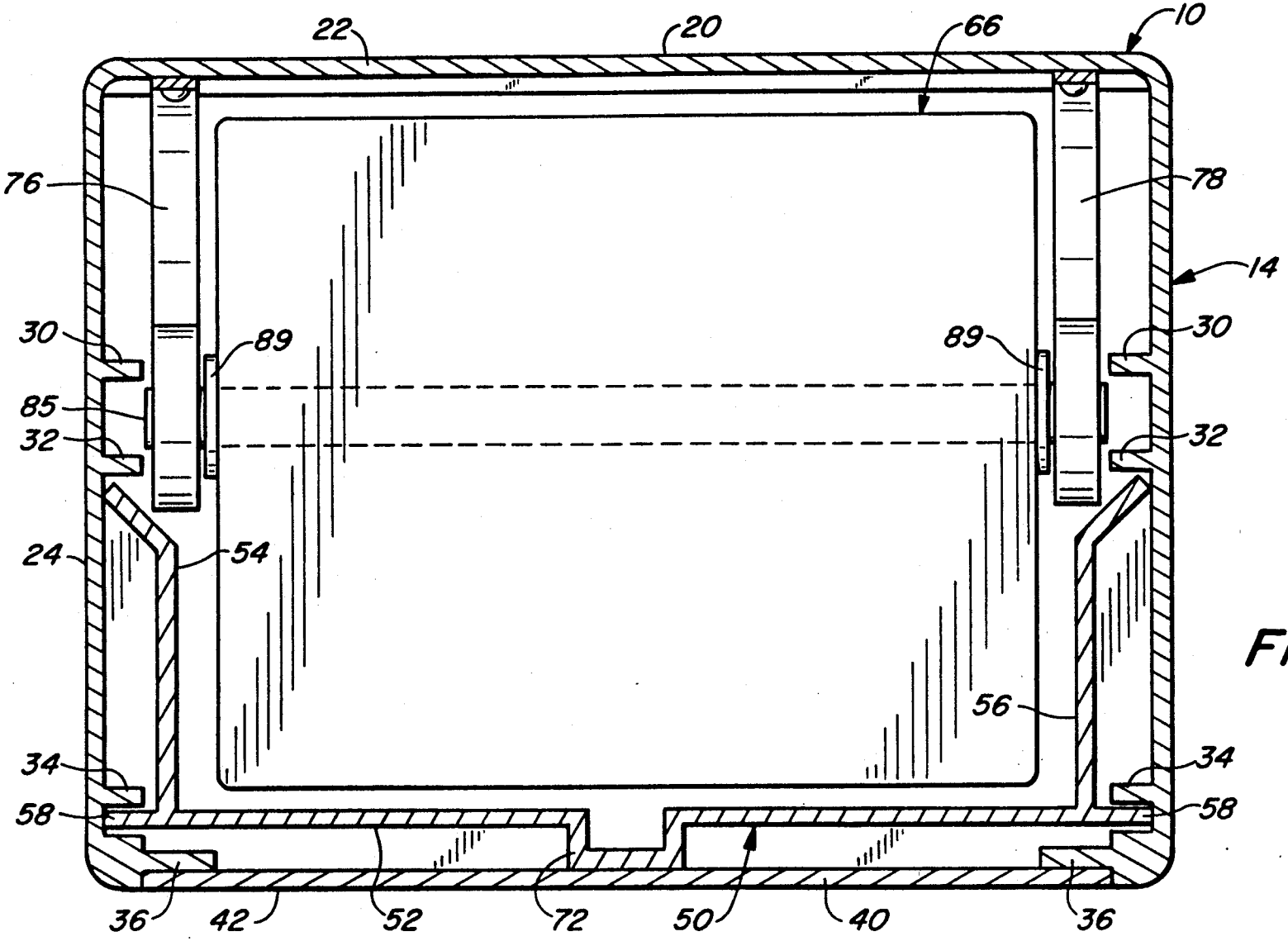
FIG. 5 is an enlarged, cross-sectional view taken along the line 5—5 in FIG. 1.
Figure 7:
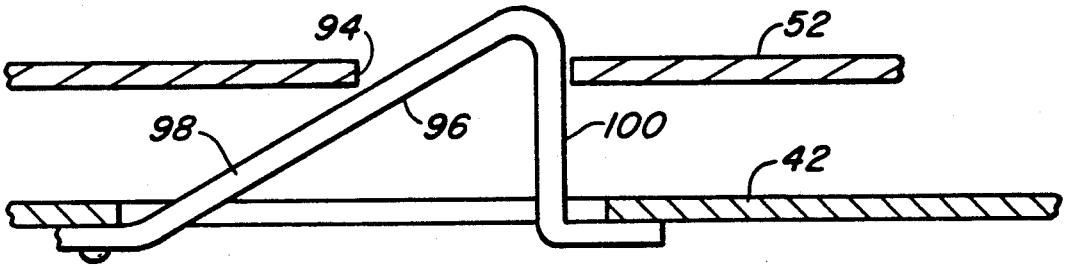
FIG. 7 is an enlarged, cross-sectional, detail view of other selected structural components of the apparatus and illustrating the cooperative relationship therebetween.

The support wall 52 defines a second opening 94 therein as shown in FIG. 7. The opening 94 is located toward the rear of the support wall as may perhaps best be seen with reference to FIG. 3 and 4. Opening 94 is registerable with a lock spring 96 attached to bottom wall 42 when the support member is opened to its second position and the lock spring 96 prevents further outward movement of the support member. Lock spring 96 is connected at one end thereof to bottom wall 42 and is continuously biased upwardly. The lock spring 96 has a tapered leg 98 and a straight leg 100 which engage the support wall 52 at opposite ends of the opening 94. It will be appreciated that inward movement of the support member will cause the lock spring to deflect downwardly out of the opening 94.

We claim:

1. Dispenser apparatus for serially dispensing folded sheet products from a stack of said folded sheet products, said apparatus comprising, in combination:

a housing defining an interior and having an open end;

a support member selectively movably mounted relative to said housing between a first position and a second position and including a support wall for supporting said stack of folded sheet products and a dispenser element defining a dispensing opening connected in said support wall, said support wall being disposed within said housing when said support member is in said first position;

follower means mounted for slidable movement along a predetermined path of movement relative to said support member;

biasing means biasing said follower means in the direction of said dispenser element;

retention means for engaging said follower means and for retaining said follower means at a predetermined location relative to said support member when said support member is in said second position, said retention means being disengaged from said follower means when said support member moves from said second position to said first position, said retention means including a retention member positioned in the path of movement of said follower means when said support member is in said second position; and engagement means engageable with said retention means when said support member moves from said second position to said first position to withdraw the retention member from the path of movement of said follower means, said support wall defining an opening at said predetermined location and said retention means additionally including spring means biasing said retention member upwardly through said opening when said support member is in said second position.

2. The apparatus according to claim 1 wherein said follower means includes a follower plate slidable relative to said support member, said retention member defining a recess for receiving said follower plate.

3. The apparatus according to claim 1 wherein said retention means is connected to said support wall and movable therewith when said support member moves between said first and second positions.

4. The apparatus according to claim 3 wherein said engagement means is affixed to said housing and engageable by said retention means when said support member moves from said second position to said first position for withdrawing said retention member from said opening.

5. The apparatus according to claim 3 wherein the retention member biasing means of said retention means includes a leaf spring member extending from said retention member and secured to said support wall at a location spaced from said retention member.

6. The apparatus according to claim 1 wherein said support wall defines at least one opening and wherein a lock spring is affixed to said housing, said lock spring being positionable in said at least one opening when said support member is in said second position to prevent further outward movement of said support member relative to said housing from said second position.

7. The apparatus according to claim 1 wherein said housing comprises a first housing member having top and side walls and a second housing member having bottom and back walls connected to said first housing member and imparting strength and rigidity thereto.

8. The apparatus according to claim 7 wherein the first housing member is formed of extruded plastic and the second housing member is formed of sheet metal.

9. The apparatus according to claim 1 wherein said biasing means includes a pair of spaced, helical coil springs, each said spring affixed to said housing at one end thereof and to a shaft at the other end thereof, said shaft being in engagement with said follower means.

10. The apparatus according to claim 9 wherein said follower means includes a follower plate and follower side walls, said follower side walls defining indents receiving said shaft.

* * * * *